US007316449B2

(12) United States Patent
Lynch et al.

(10) Patent No.: US 7,316,449 B2
(45) Date of Patent: Jan. 8, 2008

(54) EXPANDABLE AMBULATORY WALKING DEVICE AND METHOD OF USE

(76) Inventors: Mark W. Lynch, 161- W. Heather Ave., Defuniak Springs, FL (US) 32433; Peggy J. Lynch, 161- W. Heather Ave., Defuniak Springs, FL (US) 32433

( * ) Notice: Subject to any disclaimer, the term of this patent is extended or adjusted under 35 U.S.C. 154(b) by 5 days.

(21) Appl. No.: 11/359,036

(22) Filed: Feb. 21, 2006

(65) Prior Publication Data

US 2007/0194608 A1 Aug. 23, 2007

(51) Int. Cl.

| | |
|---|---|
| ***A61H 3/00*** | (2006.01) |
| ***A47C 4/00*** | (2006.01) |
| ***A47C 13/00*** | (2006.01) |
| ***A47C 7/62*** | (2006.01) |

(52) U.S. Cl. ..... 297/4; 297/6; 297/16.1; 297/17; 297/118; 297/183.1; 297/183.2; 297/217.1; 248/155.1; 248/155.2; 248/155.4; 248/155.5

(58) Field of Classification Search ..... 297/4, 297/5, 6, 16.1, 16.2, 17, 118, 183.1, 183.2, 297/195.11, 217.1; 248/155.1, 155.2, 155.4, 248/155.5

See application file for complete search history.

(56) References Cited

U.S. PATENT DOCUMENTS

| | | | | | |
|---|---|---|---|---|---|
| 176,122 | A | * | 4/1876 | Matteson | 297/118 X |
| 177,025 | A | * | 5/1876 | Smith | 248/155.1 |
| 280,843 | A | * | 7/1883 | McGaughey | 248/155.1 |
| 295,216 | A | * | 3/1884 | Wright | 248/155.5 X |
| 406,328 | A | * | 7/1889 | Yagn | 297/4 X |
| 431,338 | A | * | 7/1890 | De Kalb | 297/118 X |
| 444,621 | A | * | 1/1891 | Schneider | 248/155.1 |
| 574,011 | A | * | 12/1896 | Springsted | 297/118 X |
| 585,207 | A | * | 6/1897 | Hortman | 297/118 X |
| 617,641 | A | * | 1/1899 | Christianson | 297/118 X |
| 617,661 | A | * | 1/1899 | Smith | 297/118 X |
| 671,638 | A | * | 4/1901 | Slagle | 297/4 |
| 686,006 | A | * | 11/1901 | McConnell | 248/155.1 |
| 690,122 | A | * | 12/1901 | Slagle | 297/4 X |
| 731,437 | A | * | 6/1903 | Czermak et al. | 248/155.1 |
| 767,245 | A | * | 8/1904 | Rogers | 248/155.2 |
| 768,882 | A | * | 8/1904 | Morse | 297/118 X |
| 803,187 | A | * | 10/1905 | McNamara | 297/118 X |
| 952,335 | A | * | 3/1910 | Killian | 248/155.1 |
| 954,473 | A | * | 4/1910 | Schocke | 248/155.4 |
| 979,959 | A | * | 12/1910 | Johnson | 297/118 X |

(Continued)

FOREIGN PATENT DOCUMENTS

| | | | | |
|---|---|---|---|---|
| FR | 2597311 | A1 * | 10/1987 | 297/118 |

(Continued)

*Primary Examiner*—Rodney B. White
(74) *Attorney, Agent, or Firm*—Raymond M. Galasso; Galasso & Associates, LP

(57) ABSTRACT

An expandable ambulatory walking device and method of use are disclosed. In one form, an ambulatory walking device includes an elongated member having a first end and a second end and a rubber contact material coupled to the first end. The device further includes an expandable handle coupled a second end of the elongated member and operable to be provided in a collapsed state providing a handle. The expandable handle is also operable to be provided in an expanded state to provide a seat for the user.

11 Claims, 1 Drawing Sheet

U.S. PATENT DOCUMENTS 1,145,994 A * 7/1915 Jasinski ..... 248/155.1
1,161,604 A * 11/1915 Bragg ..... 297/4
1,166,386 A * 12/1915 Perrin ..... 248/155.2 X
1,220,316 A * 3/1917 Bragg ..... 297/4
1,241,753 A * 10/1917 Mills ..... 248/155.1
1,417,250 A * 5/1922 Kelly ..... 297/4 X
1,456,304 A * 5/1923 Fritschka ..... 248/155.1
1,502,629 A * 7/1924 Hardy ..... 248/155.1 X
1,697,552 A * 1/1929 Brooks ..... 248/155.1
1,828,144 A * 10/1931 Jasinski ..... 248/155.1
1,957,033 A * 5/1934 Silverman ..... 248/155.1
1,997,142 A * 4/1935 Hanson ..... 248/155.1
2,002,118 A * 5/1935 Johnson ..... 297/118 X
2,099,345 A * 11/1937 Olszanowski ..... 297/4
D113,534 S * 2/1939 Bodkin ..... 248/155.1 X
2,270,254 A * 1/1942 Brand ..... 248/155.1
2,360,494 A * 10/1944 Helgason ..... 248/155.1 X
2,380,437 A * 7/1945 Homrighausen ..... 297/118 X
2,629,429 A * 2/1953 Baumfeld et al. ..... 297/118 X
2,631,652 A * 3/1953 Bannister ..... 297/4
2,800,164 A * 7/1957 Chambers ..... 248/155.1
3,058,711 A * 10/1962 Kingsford ..... 248/155.2
3,310,340 A * 3/1967 Brewer et al. ..... 297/16.1
3,467,033 A * 9/1969 Remer et al. ..... 108/150
3,716,067 A * 2/1973 Skoog ..... 297/6 X
3,912,209 A * 10/1975 Turpin ..... 248/155.1
4,098,478 A * 7/1978 Spitzke ..... 297/4 X
4,101,163 A * 7/1978 Morin ..... 297/16.1
4,232,896 A * 11/1980 Caldwell ..... 297/4
4,415,198 A 11/1983 Brearley
4,451,080 A * 5/1984 Nix ..... 297/4
4,641,882 A * 2/1987 Young ..... 297/183.1
4,676,547 A * 6/1987 Spillman ..... 297/4
D291,791 S * 9/1987 Bean ..... D12/130
4,848,712 A * 7/1989 Russell ..... 297/183.1 X
4,930,839 A * 6/1990 Saito et al. ..... 297/4 X
4,974,620 A 12/1990 Quillan et al.
5,188,422 A * 2/1993 Montgomery ..... 297/195.1
5,255,697 A 10/1993 Grauer
5,411,313 A * 5/1995 Counihan et al. ..... 297/118
5,673,966 A * 10/1997 Morton, Jr. ..... 297/4
5,720,522 A * 2/1998 Habeck ..... 297/4 X
5,927,797 A * 7/1999 Ferguson ..... 297/4
6,062,638 A * 5/2000 Ferguson ..... 297/4
6,176,545 B1 * 1/2001 Hambleton ..... 297/4
6,206,019 B1 * 3/2001 Horvitz ..... 135/74
6,893,097 B1 * 5/2005 Ebensperger et al. ..... 297/4 X
6,959,716 B1 * 11/2005 Schrader ..... 297/183.1 X
2005/0242630 A1 * 11/2005 Miller ..... 297/4

FOREIGN PATENT DOCUMENTS

GB 2209276 A * 5/1989 ..... 297/6

* cited by examiner

EXPANDABLE AMBULATORY WALKING DEVICE AND METHOD OF USE

FIELD OF THE DISCLOSURE

The present invention generally relates to walking aids, and more particularly, to an expandable ambulatory walking device and method of use.

BACKGROUND

Conventional ambulatory aids provide a user with assistance in getting from one location to another. For example, a conventional wheel chair allows a handicapped user mobility while a user is in a seated position. This may be advantageous for users that may not be able to walk. Some individuals may be mobile without the use of a wheel chair but may require the assistance of a walking device such as a cane or crutch. For example a user may lean on a cane or crutch to maintain balance. However, when a user gets tired, a user must either lean on the cane or crutch until rested or locate a seat to rest. If a seat is not available, a user is left with having to sit on the ground which and may struggle with returning to a standing position. As such, what is needed is a device that may provide a user support when walking and allowing a user to rest when needed without having to locate a seat.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

An expandable ambulatory device and method of use are disclosed. According to one aspect, an ambulatory walking device includes an elongated member having a first end and a second end and a rubber contact material coupled to the first end. The device further includes an expandable handle coupled a second end of the elongated member and operable to be provided in a collapsed state providing a handle. The expandable handle is also operable to be provided in an expanded state to provide a seat for the user.

According to another aspect of the invention, an ambulatory walking device includes a first rotational seat portion operable to be rotated approximately ninety (90) degrees to provide a walking state and a seating state. The device further includes a second rotational seat opposing the first rotation seat portion and operable to be rotated approximately ninety (90) degrees in association with the first rotational seat to provide the walking state and the seating state. The device also includes an expansion mechanism including a first hinge coupled to the first rotational seat portion and a second hinge coupled to the second rotational seat portion.

According to a further aspect of the invention, an ambulatory walking device includes an elongated member having a first end portion having a rubber cap and a first hinge operable to be rotated no greater than ninety (90) degrees. The device further includes a second hinge opposing the first and operable to be rotated no greater than ninety (90) degrees. The device further includes a handle bisected along a medial line to provide a seat comprising and a first seat portion formed in a semicircular shape and coupled to the first hinge. The device also includes a second seat portion formed in the semicircular shape and coupled to the second hinge and a stop mechanism operable to limit rotation of the first hinge and the second hinge when rotated approximately ninety (90) degrees.

Figure 1:
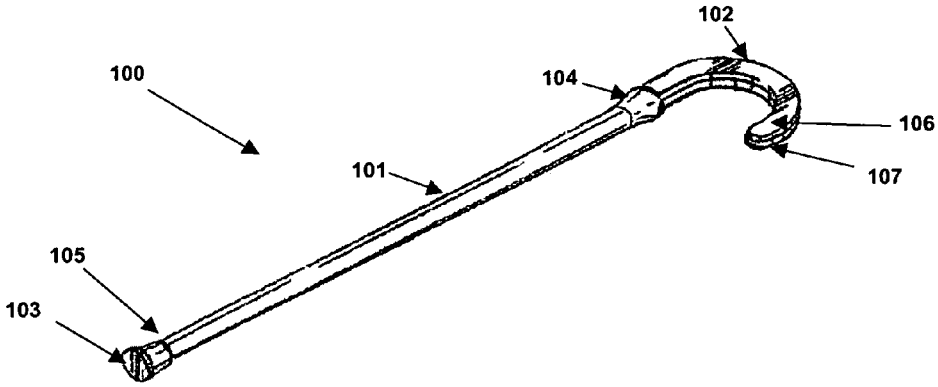
FIG. 1 illustrates an expandable ambulatory walking device and expansion mechanism according to one aspect of the present invention.

FIG. 1 illustrates an expandable ambulatory walking device and expansion mechanism according to one aspect of the present invention. An expandable ambulatory device, illustrated generally at 100, includes an elongated member 101 having an end 105 with rubber end tip 103. Expandable ambulatory device 100 further includes a collar 104 and an expandable handle 102 formed to provide a handle for a user to grasp. Expandable handle 102 is bisected into a first portion 106 and a second portion 107. Expandable ambulatory device 100 is illustrated in a collapsed state wherein first portion 106 and second portion 107 are joined to form expandable handle 102. During use, a user may grasp expandable handle 102 of expandable ambulatory device 100 and use as a traditional can or walking aid applying weight as needed to expandable handle 102 to assist with balance.

Figure 2:
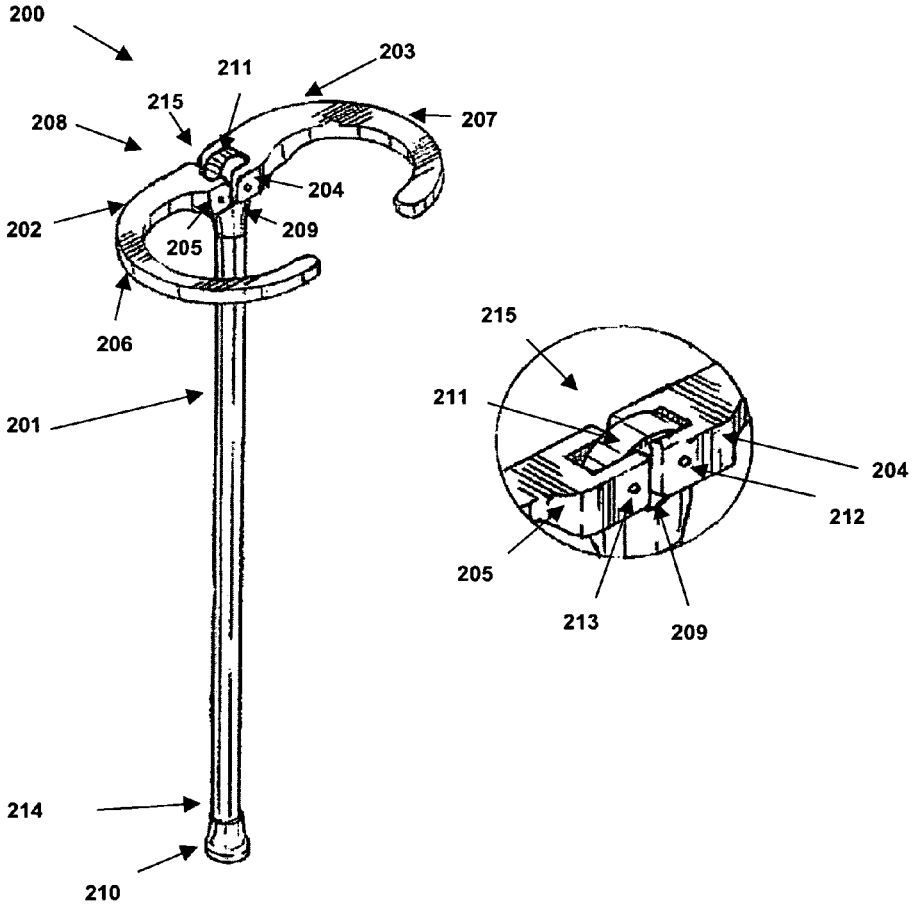
FIG. 2 illustrates an expandable ambulatory walking device provided in a collapsed state according to one aspect of the invention.

FIG. 2 illustrates an expandable ambulatory walking device provided in an expanded state according to one aspect of the invention. An expandable ambulatory device, illustrated generally at 200, includes an elongated member 201 coupled between an expandable handle 208 and an end portion 214 having a rubber cap or boot 210. A collar 209 is provided proximal to expandable handle 208 and provides a stop mechanism when expandable handle is expanded to an open or expanded state. Expandable handle 208 further includes a first handle portion 202 having a first curved portion 206. Expandable handle 208 further includes a second handle portion 203 having a second curved portion 207. First curved portion 206 and second curved portion 207 are generally circular and form a semicircle or semi oval shape to allow a user to sit on each curved portion providing support for a user. Other shapes may also be employed.

Expandable handle 208 also includes an expansion mechanism 215 for opening and closing expandable handle 208 based on desired use. Expansion mechanism 215 includes a first hinge 205 coupled to first handle portion 202 and a second hinge 204 coupled to a second handle 203. A cam 211 is coupled to first hinge 205 and second hinge 204 and guides rotation of each hinge when being opened or closed. Cam 211 is coupled to collar 209 and elongated member 201. In one embodiment, first hinge 205 is coupled to cam 211 using a first hinge pin 213 and second hinge 204 is coupled to cam 211 using second hinge pin 212. Other coupling mechanisms may also be used. Each hinge pin extends through cam 211 (not expressly shown) and cam 211 is placed within a cavity or yoke of fist hinge 205 and second hinge 204. Cam 211 may be formed from various types of materials and in one embodiment may include a rubber or plastic material that will allow for easy rotation of each handle while insuring each handle may be rotationally moved between an expanded and collapsed state.

During use a user, a user may grasp a portion of expandable handle 208 when expandable ambulatory device 200 is provided in a collapsed position similar to expandable ambulatory device 100 illustrated in FIG. 1 above. A user may expand or open expandable handle 208 by separating each handle into first handle portion 203 and second handle portion 204 and rotating each until provided in an open state or position to allow a user to sit in a seat when fully expanded. In one embodiment, collar 209 includes a stop such as a lip or ridge (not expressly shown) that inhibits rotation of first handle portion 203 and second handle portion 204 beyond approximately ninety (90) degrees thereby ensuring that stable support of an individual is maintained. In this manner, a user may utilize expandable ambulatory device 200 as a cane (when in a collapsed state) or as a seat (when in an expanded state) as needed.

In other aspects, various types of materials and alterations may be made to provide an ambulatory device that may be used as a walking aid and a seat. For example, expandable handle 208 may take on other various types of shapes and may include various types of materials. For example, first handle and second handle may include a padded material such as foam, final, etc. that may provide a cushion when seated but may also compress when expandable handle 208 is placed in a collapsed position. In another form, expandable handle 208 may include a grip that may allow for a user to maintain a grasp on an expandable handle 208 when being used as a cane. Other variations may also be employed.

Note that although an embodiment of the invention has been shown and described in detail herein, along with certain variants thereof, many other varied embodiments that incorporate the teachings of the invention may be easily constructed by those skilled in the art. Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims. Accordingly, the invention is not intended to be limited to the specific form set forth herein, but on the contrary, it is intended to cover such alternatives, modifications, and equivalents, as can be reasonably included within the spirit and scope of the invention.

What is claimed is:

1. An ambulatory walking device comprising:

an elongated member having a first end and a second end, the first end including a rubber contact material;

an expandable handle coupled to a second end of the elongated member and operable to be provided in a collapsed state providing a handle, the expandable handle operable to be provided in an expanded state to provide a seat; and an expansion mechanism operable to facilitate the collapsed state and the expanded state; and wherein the expandable handle comprises a semicircular seat portion defined by bisecting the curved shaped handle into substantially equal parts; and wherein the expandable handle further comprises a cam operable to allow rotation of the substantially equal parts to the open state.

2. The device of claim 1 wherein the expandable handle comprises a curved portion providing a handle perimeter for the handle during the collapsed state.

3. The device of claim 1, further comprising a collar located proximal to the expansion mechanism and operable to inhibit rotation of the expansion mechanism.

4. The device of claim 3, wherein the collar limits rotation of the expansion mechanism to approximately ninety degrees.

5. The device of claim 1, wherein the expansion mechanism comprises two hinges operable to be independently rotated during the expansion and collapsed states.

6. An ambulatory walking device comprising: a first rotational seat portion operable to be rotated approximately ninety degrees to provide a walking state and a seating state;

a second rotational seat opposing the first rotation seat portion and operable to be rotated approximately ninety degrees in association with the first rotational seat to provide the walking state and the seating state; and an expansion mechanism including a first hinge coupled to the first rotational seat portion;

and a second hinge coupled to the second rotational seat portion;

an expansion mechanism operable to facilitate the collapsed state and the expanded state;

and wherein the expandable handle comprises a semicircular seat portion defined by bisecting the curved shaped handle into substantially equal parts; a cam coupled between the first hinge and the second hinge; and a stop located proximal to cam, the first hinge, and the second hinge and operable to limit the rotation of the first rotational seat portion and the second rotational seat portion.

7. The device of claim 6 further comprising the stop operable to allow rotation of the first hinge and the second hinge to no greater than ninety degrees.

8. The device of claim 6 wherein the first hinge and the second hinge comprise a hinge pin extended through the cam to rotationally couple the first hinge and the second hinge to the cam.

9. The device of claim 8 further comprising release means for rotating the first rotational seat and the second rotational seat; and stop means for limiting rotation of the first rotational seat and the second rotational seat.

10. The device of claim 6 wherein the elongated member comprises aluminum.

11. The device of claim 6 wherein the first rotational seat portion and the second rotational seat portion include a first substantially flat surface operable to provide a seat when in the seating state and a second grip portion operable to provide a grip when in the walking state.

* * * * *